US009492855B2

(12) United States Patent
Heydasch

(10) Patent No.: US 9,492,855 B2
(45) Date of Patent: Nov. 15, 2016

(54) EXTRUSION PLATE AND EXTRUSION APPARATUS

(75) Inventor: Horst Heydasch, Raeren (BE)

(73) Assignee: Horst Heydasch Dummy Block GmbH & Co. KG, Luxembourg (LU)

( * ) Notice: Subject to any disclaimer, the term of this patent is extended or adjusted under 35 U.S.C. 154(b) by 501 days.

(21) Appl. No.: 13/990,990

(22) PCT Filed: Nov. 30, 2011

(86) PCT No.: PCT/EP2011/071402

§ 371 (c)(1),
(2), (4) Date: May 31, 2013

(87) PCT Pub. No.: WO2012/072688

PCT Pub. Date: Jun. 7, 2012

(65) Prior Publication Data

US 2013/0247640 A1 Sep. 26, 2013

(30) Foreign Application Priority Data

Dec. 1, 2010 (DE) ..... 10 2010 062 258
Dec. 30, 2010 (DE) ..... 10 2010 064 400

(51) Int. Cl.
*B21C 23/08* (2006.01)
*B21C 26/00* (2006.01)
*B30B 15/06* (2006.01)

(52) U.S. Cl.
CPC ..... *B21C 23/085* (2013.01); *B21C 26/00* (2013.01); *B30B 15/065* (2013.01)

(58) Field of Classification Search
CPC .... B21C 23/085; B21C 26/00; B30B 15/065
See application file for complete search history.

(56) References Cited

U.S. PATENT DOCUMENTS 5,272,900 A 12/1993 Robbins

FOREIGN PATENT DOCUMENTS

| | | |
|---|---|---|
| DE | 4132810 A1 | 4/1993 |
| DE | 7314414 U | 7/1997 |
| DE | 10036463 B4 | 8/2005 |
| GB | 2067944 | 8/1981 |

(Continued)

OTHER PUBLICATIONS

PCT/EP2011/071402 Written Opinion of the International Searching Authority; Issued Jun. 4, 2013.

(Continued)

*Primary Examiner* — Teresa M Ekiert
(74) *Attorney, Agent, or Firm* — Tarolli, Sundheim, Covell & Tummino LLP

(57) ABSTRACT

The invention relates to a dummy block (10) to be installed on the extrusion ram (20) of an extrusion device, whereby the dummy block (10) comprises at least one filler piece (30) having a pressing surface via which a force can be exerted onto a material that is to be extruded, and the outer diameter of the filler piece (30) is configured conically with an outer conical surface (31) and is surrounded by a sealing ring (40) which likewise forms part of the dummy block and whose inner diameter is dimensioned in such a way that the inner conical surface (41) of the sealing ring (40) and the outer conical surface (31) of the filler piece (30) form a gap (50). Between the filler piece (30) and the sealing ring (40), there is at least one radial gap (51) that widens conically from the inside towards the outside, whereby the filler piece (30) and the sealing ring (40) can be installed on the extrusion ram (20) by means of a connecting element (HO1), and the return force of the extrusion ram (20) can be transmitted to the sealing ring (40) via the connecting element (HO1). According to the invention, by rotating the sealing ring (40) around the axis of rotation of the dummy block (10), depending on the direction of rotation, it is possible to establish or release a secured connection of the dummy block (10) to the extrusion ram (20) against axial movement, as a result of which the sealing ring (40) and the filler piece (30) can be installed in and dismantled from the extrusion ram (20) via the front of the dummy block (10), whereby the dummy block (10) comprises the connecting element (HO1), and whereby the connecting element is a circumferential connecting member having an end face that can absorb the compressive forces during the extrusion process.

16 Claims, 5 Drawing Sheets

(56) References Cited

FOREIGN PATENT DOCUMENTS

| | | |
|---|---|---|
| JP | 51122151 U | 10/1976 |
| WO | 9803277 | 1/1998 |

OTHER PUBLICATIONS

International Search Report PCT/EP2011/071402; completed Feb. 12, 2012. The International Search Report lists the patents/patent applications identified above and indicates which of the originally filed claims the cited document is relevant to.

EXTRUSION PLATE AND EXTRUSION APPARATUS

CROSS REFERENCES TO RELATED APPLICATIONS

This application filed under 35 U.S.C §371 is a national phase application of International Application Serial Number PCT/EP2011/071402 filed Nov. 30, 2011, which claims priority to German Application 102010062258.3, filed Dec. 1, 2010 and German Application 102010064400.5, filed Dec. 30, 2010.

TECHNICAL FIELD

The invention also relates to an extrusion device having such a dummy block.

BACKGROUND ART

Extrusion presses are known from the state of the art that comprise dummy blocks with which pressure can be transmitted onto the material that is to be extruded. As a rule, the dummy blocks are rotation-symmetrical and are accommodated in a holder that sheathes them during the extrusion process. As a rule, the dummy block is made of metal such as hot work steel.

During extrusion, the dummy block is subjected to a high compressive load and to a diameter enlargement, which are associated with stressing of the material. This stress causes wear and tear of the dummy block material. Moreover, the extrusion devices according to the state of the art entail the problem that, at the beginning of the extrusion process, air that is contained in the holder often cannot escape completely, and this has a detrimental effect on the material to be extruded.

Therefore, efforts are aimed at developing dummy blocks that involve the least possible material stress and that thus translate into a longer service life of the dummy block. For example, German patent DE 100 36 463 B4 discloses an advantageous dummy block and an extrusion device having such a dummy block, wherein the dummy block comprises a filler piece having a pressing surface with which a force can be exerted onto a material that is to be extruded. The filler piece is surrounded by a sealing ring whose inner diameter is dimensioned in such a way that the inner conical surface of the sealing ring and the outer conical surface of the filler piece form a first gap. Moreover, at least one radial gap, which widens conically from the inside towards the outside, runs between the filler piece and the sealing ring.

With an eye towards improving such a prior-art dummy block, it comprises various parts that, for instance, can also be configured in one piece in order to reduce the number of parts. Moreover, it would be desirable if the overall height of the dummy block could be reduced so as to reduce the total weight and thus facilitate the assembly and disassembly. However, this is not possible with the prior-art dummy blocks without severely impairing the functionality and service life of the dummy block.

Moreover, it would be advantageous if it were possible to remove and replace only the wearing parts of a dummy block via the front, without having to dismantle the entire construction. At the least the sealing ring and the filler piece can be viewed as wearing parts since they are highly stressed during operation in an extrusion press and which display wear and tear.

If one wants to replace only the filler piece and the sealing ring of the dummy block known from German patent DE 100 36 463 B4, however, it is necessary to completely dismantle several other parts before the filler piece and the sealing ring can be removed.

International patent application WO 98/03277 A1 describes a dummy block having a base part, a connecting element to connect the base part to an extrusion ram, a replaceable closing ring on a front area that surrounds the dummy block, as well as a device for detachably securing the closing ring to the base part. Moreover, the dummy block comprises a device for latching the billet container into the closing ring during the extrusion. The closing ring is made of metal and has a conical inner surface that converges towards the base part. The device for latching the billet container into the closing ring contains a metal extrusion ram with an end face having a conical surface, whereby the end face of the extrusion ram is pressed into the ring during the extrusion. The converging surfaces of the ring and the end face of the extrusion ram are at such a distance that the extrusion ram is prevented from entering the ring.

German utility model DE 73 14 414 U describes a dummy block for the extrusion rams of extruders, whereby the end face of the dummy block has a circular recess facing the material that is to be pressed, and it also has a conical seat surface for placement of an inner plate that, when it has been positioned, is flush with the end face of the dummy block.

Moreover, German patent application DE 41 32 810 A1 discloses a fixed dummy block for the extrusion ram of a metal extruder having a venting means. Due to the convex configuration of the side of the dummy block facing the material that is to be pressed, the air entrapped during the upsetting of the billet in the extrusion container can escape via the closing ring that has not yet spread as well as via the bores arranged in the spreading ring.

DISCLOSURE OF THE INVENTION

The invention relates to a dummy block to be installed on the extrusion ram of an extrusion device, whereby the dummy block comprises at least one filler piece having a pressing surface via which a force can be exerted onto a material that is to be extruded. The filler piece is surrounded by a sealing ring which likewise forms part of the dummy block and whose inner diameter is dimensioned in such a way that the inner conical surface of the sealing ring and the outer conical surface of the filler piece form a first gap. Moreover, between the filler piece and the sealing ring, there is at least one radial gap that widens conically from the inside towards the outside.

Therefore, the objective of the invention is to put forward a dummy block that has an efficient venting system, high resistance to wear and tear, and consequently a long service life, that has the smallest possible overall height, and whose wearing parts can be very easily installed and dismantled via the front, without numerous other parts likewise having to be installed and dismantled for this purpose.

Another objective of the invention is to put forward an extrusion device having such a dummy block.

The dummy block according to the invention as put forward in the generic part of claim 1 is characterized in that, by rotating the sealing ring around the axis of rotation of the dummy block, depending on the direction of rotation, a secured connection of the dummy block to the extrusion ram against axial movement can be established or released, as a result of which the sealing ring and the filler piece can be installed in and dismantled from the extrusion ram via the front of the dummy block. Consequently, by rotating the sealing ring, the wearing parts such as the filler piece and the sealing ring can be easily installed and dismantled via the front.

A decisive aspect for the mode of operation of the dummy block according to the invention, however, is also the fact that the return forces are transmitted to the sealing ring via the connecting element. Even under the maximum compressive load, the sealing ring only spreads to a limited extent and consequently, it is not stressed in the cone during the return movement, thereby preventing spreading due to friction forces on the holder. Moreover, a bending stress is generated, which greatly reduces the wear and tear of the dummy block, especially of the conical surfaces, and which widens the dummy blocks at the desired point in time. The radial gap between the filler piece and the sealing ring makes this bending moment in the filler piece possible, thereby resulting in a greater wear-resistance of the filler piece and thus of the dummy block. Moreover, during the upsetting procedure, the pressure is transmitted to the middle of the material that is to be pressed before the dummy block widens, which leads to a better and particularly more uniform venting.

Consequently, this type of dummy block yields a longer service life, it undergoes less wear and tear, thus permanently ensuring the diameter enlargement and the subsequent relief. Moreover, the entrapment of air in the extrusion volume is prevented, thereby improving the quality of the extrusion.

Owing to the selected design of the dummy block and of a connecting element that, on the one hand, joins the dummy block to an extrusion ram or to the adapter of an extrusion ram and, on the other hand, transmits the return forces to the sealing ring, the overall height of the dummy block can be considerably reduced, which results in a material savings as well as in simpler handling.

Moreover, it is possible that not only the return forces but also the compressive forces are transmitted via the appertaining connecting element, as a result of which the overall height of the dummy block can likewise be reduced, without negatively affecting the functionality and service life of the dummy block. In this process, the sealing ring retains its elasticity, in spite of the small overall height. Here, at least part of the end face of the connecting element is in contact with at least part of the surface of the adapter piece, and at least part of the surface of the sealing ring opposite from the material to be pressed is likewise in contact with at least part of the surface of the adapter piece when extrusion pressure is applied onto the dummy block. Due to the elasticity of the material used for the sealing ring, which is normally made of hot work steel, it is possible to produce such an arrangement with an acceptable amount of manufacturing effort. The heights of the individual elements that are in contact with each other, namely, the connecting element, the adapter piece and the sealing ring, have to be produced with a manufacturing tolerance of just a few hundredths of a millimeter. When a specific hot work steel is used, achieving a tolerance, for example, of ±0.03 mm has proven to be sufficient.

The overall heights that can be achieved depend on the elasticity of the hot work steel employed. For dummy block diameters of 6 inches to 25 inches, this construction method makes it possible to achieve very small overall heights in the order of magnitude of 40 mm to 105 mm, assuming that the overall height of the dummy block is considered to be approximately the distance between the pressing surface and the extrusion ram or an adapter piece of the extrusion ram. Here, the connecting elements that extend into the extrusion ram or into an adapter piece of the extrusion ram do not contribute to the overall height of the dummy block as set forth in this invention.

However, the above-mentioned overall heights of the dummy block should not be construed as a limitation of the invention, but rather, even at greater overall heights, the structure of the dummy block according to the invention has advantages, especially when it comes to installing and dismantling as well as replacing wearing parts.

The connecting element employed can be realized in various ways, whereby all of the embodiments have in common the fact that the return forces can be transmitted to the sealing ring via the appertaining connecting element, and the wearing parts of the dummy block can be installed or dismantled via the front by rotating the sealing ring around the axis of rotation of the dummy block. In a few possible embodiments of the invention, the dummy block surrounds the connecting element, and the sealing ring is connected to the connecting element in such a way that a rotation of the sealing ring around the axis of rotation of the dummy block brings about an equidirectional rotation of the connecting element around the axis of rotation of the dummy block. In this manner, depending on the direction of rotation, it is possible to establish or release a secured connection of the connecting element to the extrusion ram against axial movement, and, together with the sealing ring and the filler piece, the connecting element can also be installed in or dismantled from the extrusion ram via the front of the dummy block.

Here, the connecting element can be, for example, a connecting stud that can be secured to the extrusion ram against axial movement and that extends through the sealing ring into the filler piece, whereby the connecting stud is configured in such a way that it secures the filler piece as well as the sealing ring against axial movement. In a refinement of this embodiment, the connecting stud and the filler piece can also be configured as a one-piece part, which can further facilitate the production of the dummy block.

In another embodiment of the invention, the connecting element is a connecting ring that surrounds an adapter stud, whereby the adapter stud is secured to the extrusion ram against axial movement, and the connecting ring is secured to the adapter stud against axial movement. Here, the sealing ring is secured to the connecting ring against a rotatory movement, and a rotation of the sealing ring around the axis of rotation of the dummy block brings about an equidirectional rotation of the connecting ring around the axis of rotation of the dummy block, as a result of which, depending on the direction of rotation, the connecting ring can be connected to or disconnected from the adapter stud. The connection between the connecting element and the sealing ring can comprise at least one pin connection.

The connecting element in question can have at least one step with an essentially radial tensioning surface on its circumference, so that the return force of the extrusion ram can be transmitted to the sealing ring via this tensioning surface. This has the advantage that the return force can be systematically applied to a specific surface of the sealing ring.

In another embodiment, the extrusion ram comprises the connecting element and, by rotating the sealing ring around the axis of rotation of the dummy block, depending on the direction of rotation, it is possible to establish or release a secured connection of the sealing ring to the connecting element against axial movement. As a result, the sealing ring and the filler piece can be installed in and dismantled from the extrusion ram via the front of the dummy block, while the connecting element remains on the extrusion ram. This embodiment permits a further reduction in the number of parts that have to be attached or detached during the installation and dismantling of the dummy block.

When the extrusion ram as well as the dummy block comprise the connecting element, it is advantageous for the connecting element to be a circumferential connecting member that extends into a corresponding, likewise circumferential, recess in an opposite part. In this case, the filler piece is secured to the sealing ring against axial movement, independently of this connecting element, and means are provided between the connecting member and the recess for establishing and releasing a secured connection between the sealing ring and the extrusion ram against axial movement. Via these means, the return force of the extrusion ram can be transmitted to the connecting member and thus to the sealing ring.

The connecting member can thus be installed on the sealing ring or on the extrusion ram or on an adapter piece of the extrusion ram, and in each case, the corresponding circumferential recess is created on the opposite part in such a way that the connecting member extends into this recess when the dummy block is installed. If the connecting member is provided on the sealing ring, the recess is thus in the extrusion ram, whereas it is in the sealing ring if the connecting member is installed on the extrusion ram. Which of these two arrangements is selected can be a function of the dimensions of the dummy block, since the connecting member can be provided, for example, on the sealing ring, and the recess can be provided in the extrusion ram if there would otherwise not be enough space for the recess in the sealing ring.

The means for establishing and releasing a secured connection between the sealing ring and the extrusion ram against axial movement can comprise, for example, a bayonet lock. Here, there are at least two bayonet cams on the outer and/or inner edge of the connecting member, while corresponding guide slots are provided on the outer and/or inner edge of the recess in order to receive these bayonet cams.

In this manner, the dummy block can be installed on or dismantled from the extrusion ram by using the bayonet lock and making a simple push-turn movement. Here, the end face of the connecting member offers a sufficient surface area to absorb the compressive forces during the extrusion process, whereas the return movement of the extrusion ram can be transmitted to the sealing ring via the bayonet cams. Moreover, this embodiment with the circumferential connecting member and the bayonet has the advantage that it permits a floating bearing of the dummy block for all design variants of the dummy block.

Moreover, the dummy block can comprise an intermediate element that is arranged between radial surfaces of the sealing ring and of the filler piece. At least one groove can have been created in at least one pressure-loaded surface of this intermediate element. As an alternative or in addition to this, the intermediate element can be made of a material that is not as hard as the material of the filler piece and/or of the sealing ring.

If the filler piece is supported by a floating bearing between the sealing ring and the connecting element, then there can preferably be a contact surface that adjoins the outer conical surface of the filler piece and runs essentially axially in the direction of the extrusion ram, and that is situated opposite from an equidirectional contact surface of the sealing ring, whereby a contact surface of the sealing ring adjoins the inner conical surface thereof. The radial distance between these two contact surfaces is then preferably smaller than the radial distance between the inner conical surface of the sealing ring and the outer conical surface of the filler piece. This embodiment especially makes it possible to prevent the gap between the outer conical surface and the sealing ring from being detrimentally reduced to zero, while a larger gap might remain between the filler piece and the connecting element, which might be neither necessary nor even desirable.

The invention also comprises an extrusion device that contains such a dummy block according to the invention.

Preferably, an anti-twist means is provided between the sealing ring and the extrusion ram, and this means can be configured in different ways. For example, the extrusion ram comprises an adapter piece and an encircling outer ring having two end faces of which one end face is oriented in the direction of the sealing ring. The sealing ring is secured by means of at least one pin connection on the outer ring against a rotatory movement, while the other end face of the outer ring is oriented in the direction of a connecting surface of the adapter piece. This other end face of the outer ring and/or the opposite connecting surface of the adapter piece have a groove section with several radial half-grooves, and a connecting pin can be inserted into at least two opposite half-grooves. Due to the indentations for connecting pins provided on both sides of the outer ring, there is an adequate number of positions in which the sealing ring can be secured against twisting relative to the extrusion ram, so that the dummy block can be screwed onto the extrusion ram as far as necessary, without being negatively restricted by the various possible anti-twist means.

Another advantageous anti-twist means consists of the face that a screw is screwed into the connecting element via the front of the dummy block and this screw has a thread that is opposite to that of the dummy block, thereby preventing the dummy block from being detached.

Additional advantages, special features and practical refinements of the invention can be gleaned from the subordinate claims and from the presentation below of preferred embodiments, making reference to the figures.

BEST MODE FOR CARRYING OUT THE INVENTION

Figure 1:
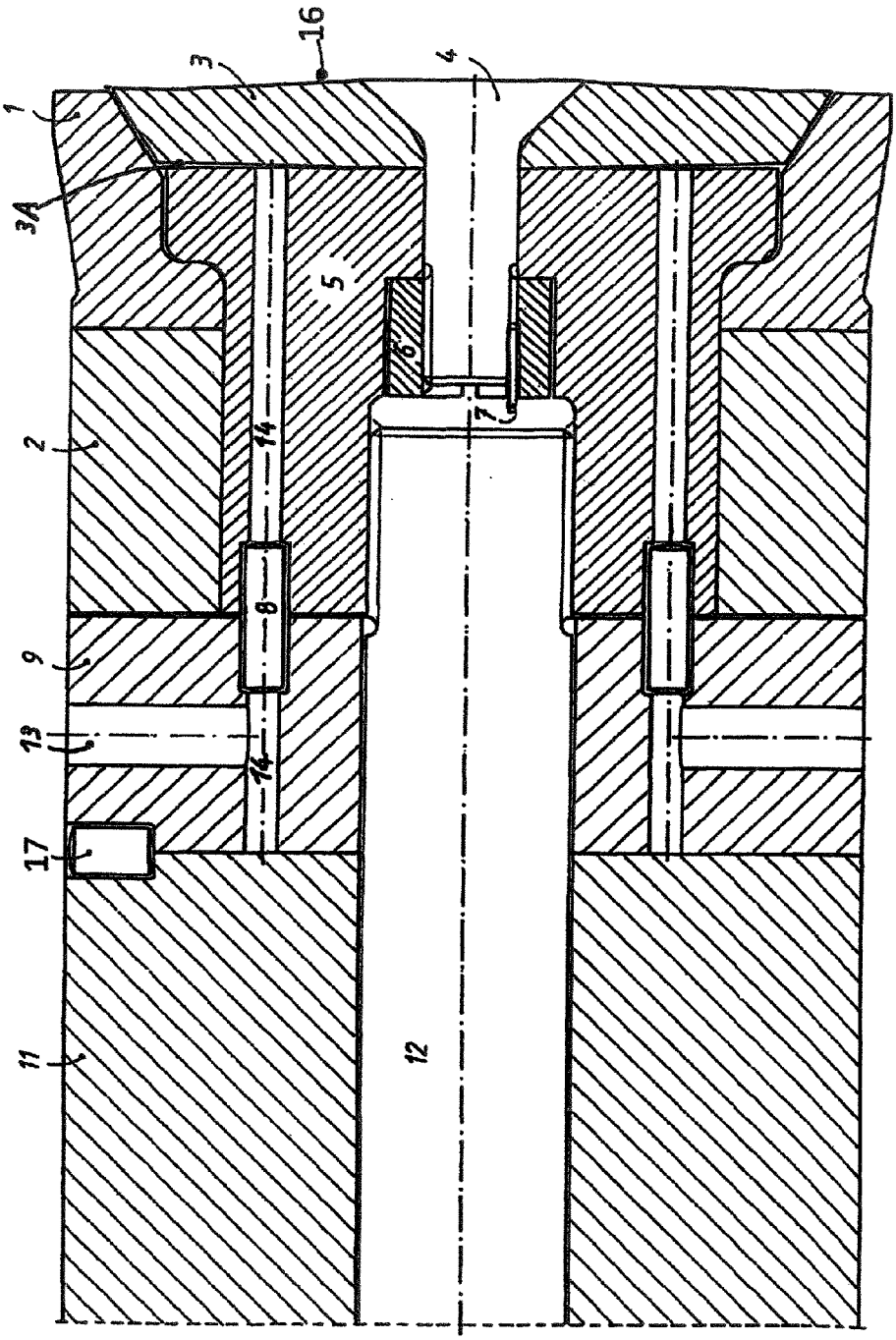
Fig.1 PRIOR ART
FIG. 1 a dummy block according to the state of the art.

FIG. 1 shows an embodiment of the dummy block from the state of the art described above. Here, the dummy block consists of a dummy block core 5 on which, by means of a centering stud 4 as the fastening means, a filler piece 3 that is shaped conically towards the outside is screwed into a nut 6 incorporated in the dummy block core 5, whereby the filler piece has a pressing surface 16. The nut 6 is locked by a securing pin 7. The filler piece 3 surrounds a sealing ring 1 onto which, in turn, an intermediate ring 2 has been placed, which also surrounds the dummy block core 5. A radial gap 3A is formed between the sealing ring 1 and the filler piece 3. Another supporting ring 9 is laid behind the intermediate ring 2. Parallel to the axis of rotation of the dummy block, indicated in the middle by the broken line, four bores 14 run at an angle of 90° through the supporting ring 9 and continue in the dummy block core 5. The bores 14 widen in the front area of the supporting ring 9 and in the rear area of the dummy block core 5, and they each accommodate a centering pin 8. The bores 13 for wrenches to screw and unscrew the dummy block open up into the bores 14 in the supporting ring 9. A tie rod, or a connecting stud 12, passes through the supporting ring 9 and the dummy block core 5 along the axis of rotation. An extrusion ram 11 is laid behind the supporting ring 9, and the tie rod 12 likewise passes through this extrusion ram 11. The extrusion ram 11 and the supporting ring 9 accommodate the securing pin 17 in a cavity.

If one wishes to replace the wearing parts in the form of the filler piece 3 and the sealing ring 1 in this dummy block, it is necessary to detach the centering stud 4, the dummy block core 5, the intermediate ring 2, the supporting ring 9, the fastening means for the filler piece and all of the pin connections. The sealing ring then has to be pushed off towards the rear and a new sealing ring has to be installed, also from the rear, before the individual components can be put back on the extrusion ram.

Moreover, the overall height of this prior-art dummy block cannot be reduced to any considerable extent without detrimentally affecting the functionality and thus the service life of the dummy block, since all of the parts employed require a certain height in order to absorb the occurring tensile and compressive loads and to fulfill their function over the long term.

Therefore, it is provided according to the invention to retain the construction of the dummy block in the form of a filler piece and a sealing ring having a first gap between the conical surface of the filler piece and the sealing ring and in the form of a second radially symmetrical gap in order to utilize the advantages of this construction. The rest of the construction and especially the installation of the dummy block on an extrusion ram or on the adapter of an extrusion ram, however, are designed differently so that the envisaged objectives can be achieved.

The invention can be achieved in different ways, whereby different applications can call for different embodiments that are adapted to the circumstances on hand. For example, for the design of the dummy block, it can be crucial whether a floating bearing has to be implemented inside the parts of the dummy block or whether the connection to the dummy block is already supported on a floating bearing.

Figure 2:
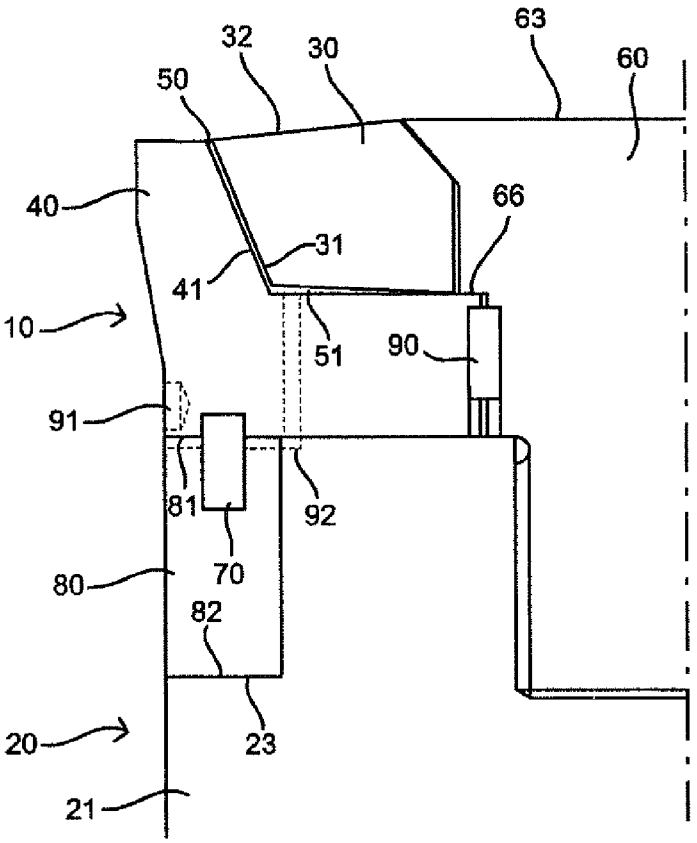
FIG. 2 a schematic view of a first embodiment of a dummy block according to the invention, in conjunction with the extrusion ram of an extrusion device, whereby the connecting element is a connecting stud.

FIG. 2 shows a first embodiment of a dummy block according to the invention, in a schematic half-section, in which the connecting element is configured as a connecting stud 60 that is screwed into a bore in the extrusion ram 20 or into an adapter piece 21 on the extrusion ram. This connecting stud extends through the sealing ring 40 into the filler piece 30 and its front end has a conical shape in order to hold the filler piece with a positive fit. Consequently, the front surface of the connecting stud 60, as the pressing surface 63, augments the pressing surface 32 of the filler piece 30, whereby the entire pressing surface thus formed is slanted downward, for instance, at the transition zone from the connecting stud 60 to the filler piece 30, and is thus curved outwards. Therefore, at the beginning of an extrusion process, the middle area of the entire pressing surface first comes into contact with the material to be pressed.

The filler piece 30 surrounds a sealing ring 40, whereby a gap 50 is preferably provided between the outer conical surface 31 of the filler piece 30 and the inner conical surface 41 of the sealing ring 40. The inner diameter of the sealing ring is configured in such a way that it has minimal contact with the outer conical surface 31 of filler piece 30, or else it forms the gap 50 with this conical surface, as long as the dummy block does not exert any pressure on the material to be pressed.

Moreover, between the filler piece 30 and the sealing ring 40, there is another radially symmetrical gap 51 that widens conically from the inside towards the outside. Due to this conical surface on the side of the filler piece 30 facing the extrusion ram 20, the inner conical surface 41 of the sealing ring 40 is virtually unstressed when the compression process is initiated. The pressure that arises is transmitted to the sealing ring 40 in the area of the radial gap 51. As a result, the air still present in the holder can escape since the sealing ring 40 is not pushed towards the outside already at the beginning of the extrusion process. After the complete pressure loading of the filler piece 30, it is pressed into the sealing ring under flexural load. In this manner, the sealing ring 40 spreads at the precisely defined point in time when the air has escaped, thereby creating a seal. The escape of air also leads to the fact that the extrusion is not impaired by air inclusions, which would cause flaws in the extruded material. After the extrusion process has been completed, the filler piece 30 reacquires its original shape and the sealing ring 40 is relieved.

During the return movement of the extrusion ram 20, the tensile force is transmitted from the connecting stud 60 to the sealing ring 40. This prevents the conical surfaces of the sealing ring 40 and of the filler piece 30 from being in contact with each other in the area of the gap 50. This permits a friction-free return movement, as a result of which the service life of the dummy block 20 is increased. There is preferably a certain amount of play in the order of magnitude of 0.1 mm to 1.4 mm, relative to the diameter, between the filler piece 30 and the connecting stud 60 and/or between the sealing ring 40 and the connecting stud 60, in order to achieve a floating bearing for these parts relative to the connecting stud 60.

In one embodiment of the invention, the circumference of the connecting stud 60 has a step with a radial tensioning surface 66. This tensioning surface 66 is in contact with the sealing ring 40 and, during the return movement of the extrusion ram, the return force is transmitted from the connecting stud 60 to the sealing ring 40 via this tensioning surface.

In a modification of this embodiment, the connecting stud 60 and the filler piece 30 can also be configured as a one-piece part, so that the tensioning surface 66 is configured to transmit the return force via the step-shaped transition zone between these two areas.

Owing to the described construction of the dummy block 10, the overall height of the dummy block can be substantially reduced as compared to prior-art dummy blocks, without the functionality and service life of the dummy block being impaired. This is achieved especially in that the connecting element in the form of the connecting stud 60 extends into the filler piece 30 and can transmit the return force as well as the compressive force.

The assembly and disassembly of the wearing parts in the form of the sealing ring 40 and the filler piece 30 can be carried out in a simple manner by means of the connecting stud 60. For this purpose, the sealing ring 40 is positively connected to the connecting stud 60, which can be achieved, for example, by one or more pin connections 90, as is shown in FIG. 2. Owing to this connection, a rotation of the sealing ring 40 around the axis of rotation of the dummy block 10 brings about a rotation of the connecting stud 60. Therefore, by rotating the sealing ring 40, the connecting stud 60 can be screwed into or unscrewed out of the extrusion ram 20 or the adapter piece 21 of the extrusion ram 20, which, due to the construction of the dummy block 10, directly establishes or releases the connection of the dummy block 10 to the extrusion ram. The filler piece 30 and the sealing ring 40 can be quickly and simply removed via the front, whereby an appropriate wrench grips an indentation 91 (indicated by a broken line) on the circumference of the sealing ring 40 in order to rotate it.

In order to prevent twisting relative to the extrusion ram 30 once the dummy block 10 has been installed, the surface of the sealing ring 40 facing the extrusion ram can be connected to the extrusion ram or to an adapter piece by means of a pin connection. For this purpose, the adapter piece and/or on the sealing ring 40 can be provided with several bores with which this connection could be created, so that several fastening sites are available for tightening the connecting stud and thus the dummy block onto the adapter. This can also be achieved by means of radial half-grooves and radial connecting pins, and thus it would be possible, for example, to screw the connecting stud 60 all the way or almost all the way to the end of a blind hole in the adapter, and then to secure the dummy block in a suitable position against twisting, which would improve the absorption of the compressive force via the connecting stud. Here, several half-grooves for affixing a pin would then be provided.

In order to achieve an even more flexible design for the anti-twist means, the sealing ring 40 can also be in contact with an outer ring 80, as in the embodiment shown in FIG. 2, and can be connected positively to said outer ring 80 by means of at least one pin connection 70. However, the associated connecting pin preferably extends only as far as necessary into the sealing ring 40 so as not to weaken it excessively. Since the sealing ring 40 should not be designed too high in order to achieve the envisaged reduction of the overall height of the entire dummy block 10, this makes a contribution to the advantageous construction of the dummy block.

The outer ring 80, in turn, can be rotated around the adapter piece 21 of the extrusion ram 20 and can preferably be locked in any required position. This can be achieved, for instance, in that the inner diameter of the outer ring 80 is reduced by a screw connection so as to affix the outer ring to the adapter piece 21. In this manner, when the dummy block 10 is tightened, the sealing ring 40 can first be connected to the outer ring 80 by means of the pin connection 70. Then the connecting stud 60 is screwed into the adapter 21 until it reaches the desired position, whereby the detached outer ring 80 can still rotate around the adapter 21. In the desired position, the outer ring 80 is then affixed to the adapter 21 by reducing the inner diameter and by the clamping force thus produced.

As an alternative to affixing the outer ring 80 to the adapter by means of a clamping force, it is likewise possible to provide pin connections between the outer ring 80 and the adapter 20, which is explained with reference to the embodiment of FIG. 3. However, this type of anti-twist means is not limited to the embodiment of FIG. 3, but rather can also be employed in other embodiments of the invention. Fundamentally, the invention is not limited to the embodiments described here, but rather, modifications and especially combinations of individual features are encompassed by the invention.

A possible venting bore 92 is depicted in FIG. 2, likewise only by a broken line, but this shows that the venting in the dummy block according to the invention can be realized with the smallest possible overall height over a short distance, and air can escape quickly from the radial gap 51 between the filler piece 30 and the sealing ring 40.

Figure 3:
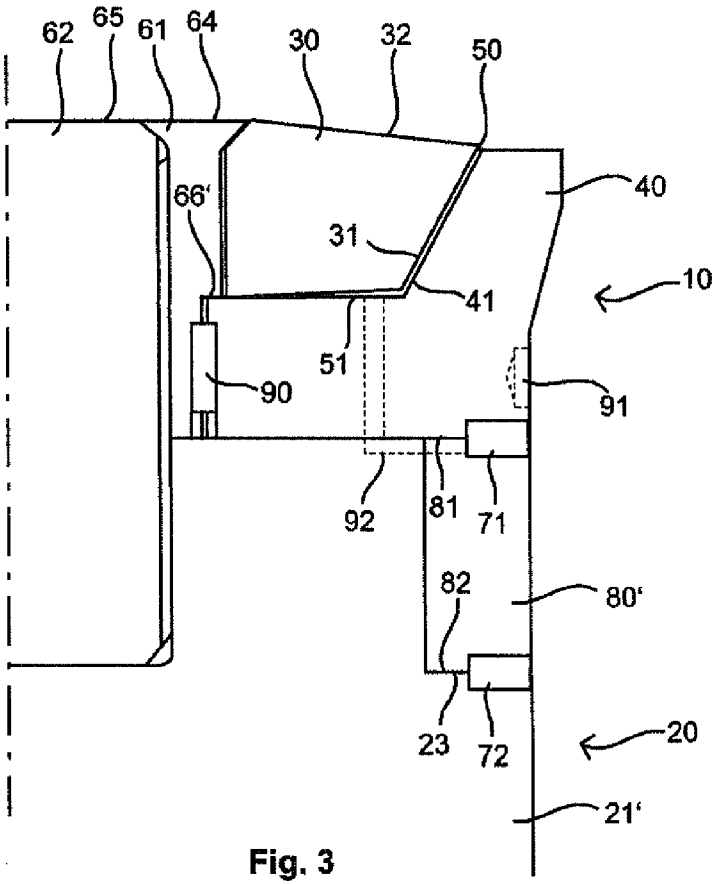
FIG. 3 a schematic view of a second embodiment of a dummy block according to the invention, in conjunction with the extrusion ram of an extrusion device, whereby the connecting element is a stepped connecting ring, and an adapter piece forms part of the pressing surface.

FIG. 3 shows a schematic half section of a second embodiment of the dummy block according to the invention, whereby the connecting element forms a stepped connecting ring 61, and an adapter stud 62 forms part of the pressing surface. Here, the adapter stud 62 can be detachably screwed into the adapter 21 or else can be permanently joined to it or shaped in one piece with the adapter 21. The adapter stud 62 is surrounded by a connecting ring 61 that serves as a connecting element as set forth by the invention, whereby the return force can be transmitted to the sealing ring 40 via this connecting element.

The return force is preferably transmitted via a step on the circumference of the connecting ring 61 having a radial tensioning surface 66' that is in contact with the sealing ring 40 when the extrusion ram 20 is retracted together with the adapter stud 62. The return force is transmitted from the adapter stud 62 to the connecting ring 61, for example, by means of a threaded connection, whereas there can be a certain amount of play between the connecting ring 61 and the filler piece 30 as well as between the connecting ring 61 and the sealing ring 40, in order to realize a floating bearing of these parts.

The connecting ring 61 preferably widens towards the inside and towards the outside on the side facing the material to be pressed, thereby holding the filler piece 30 with a positive fit. Here, the connecting ring 61 extends into the filler piece 30 and also through it, so that the front of the connecting ring—since the pressing surface 64 augments the pressing surface 32 of the filler piece 30—forms another part of the pressing surface of the dummy block 10. The same applies to the adapter stud 62 that likewise penetrates the filler piece 30, forming another pressing surface 65 with its front. Preferably, the entire pressing surface thus formed tapers at the transition zone between the connecting ring 61 and the filler piece 30, thus once again being configured to be arched towards the outside.

The connecting ring 61 can also be configured in such a way that its front surface covers the adapter stud 62, that is to say, the front surface 64 of the connecting ring 61 forms the middle part of the entire pressing surface of the dummy block, while the filler piece 30 forms an outer surface. The adapter stud 62 then extends into the connecting ring 61, but does not penetrate it completely.

In any case, by selecting suitable dimensions and tolerances, the compressive forces that are transmitted to the dummy block via the material to be pressed can be transmitted to the appertaining surface of the adapter piece 21" via the surface of the connecting ring 61' as well as to the surface of the adapter piece 21 via the surface of the sealing ring 41 facing away from the material to be pressed. For this purpose, an appropriate double fit can be made as a function of the elasticity of the sealing ring 40 by observing a tolerance of a few hundredths of a millimeter, which can be achieved without any problem by using the appropriate machine tools. For example, observing a tolerance of ±0.03 mm has proven to be sufficient when a specific hot work steel is used.

In order to install the dummy block on or to dismantle it from the extrusion ram 20 or an adapter piece 21 of the extrusion ram 20, the sealing ring 40 is positively connected to the connecting ring 61 by means of the pin connection 90 already explained above. Consequently, a rotation of the sealing ring 40 around the axis of rotation of the dummy block 10 brings about a rotation of the connecting ring 61 in the same direction, as a result of which the dummy block 10 is detached from the adapter stud 62, which remains in the adapter 21.

The anti-twist means of the sealing ring 40 relative to the extrusion ram 20 is configured differently than in the embodiment as shown in FIG. 2 and is to be explained here by way of an example, but it can also be implemented in other embodiments. The sealing ring 40 is connected to the outer ring 80 by means of a pin connection 71, whereby this can be at least one axially inserted pin or else at least one radially inserted pin, as is shown in FIG. 3.

In the case of radially inserted pins, at least one radial half-groove into which a pin can be inserted is created in the upper end face 81 of the outer ring 80 as well as in the lower surface of the sealing ring 40, when the sealing ring 40 is arranged relative to the outer ring 80 in such a way that two opposite half-grooves complement each other to form a bore. Preferably, however, several half-grooves are made at various angles in the outer ring 80 so as to cover different positions where one or more half-grooves can come to lie in the sealing ring 40 during the installation of the dummy block.

On the other side of the outer ring 80, on its second end face 82, there are additional half-grooves which are, however, arranged offset at various angular positions with respect to the half-grooves on the first end face 81. On a connecting surface 23 of the adapter piece 21 to the outer ring 80, there are likewise one or more half-grooves which are arranged offset with respect to each other and which, together with the half-grooves on the end face 82 of the outer ring, form bores for inserting at least one connecting pin when the half-grooves are opposite from each other.

If the sealing ring 40 and thus the dummy block 10 are tightly screwed onto the adapter stud 62, a first selection can be made as to which half-grooves are best-suited for connecting the sealing ring 40 to the outer ring 80. The half-groove crown on the connecting surface relative to the adapter 21 then offers additional positions for purposes of connecting the outer ring 80 to the adapter. Since the half-grooves are arranged offset with respect to each other at various angular positions on both end faces of the outer ring 80, a sufficient number of positions are obtained to be able to screw the sealing ring 40 as close as possible to the adapter 21 and to secure it there against twisting, without having to create too many bores/grooves in one side of a given part.

Figure 4:
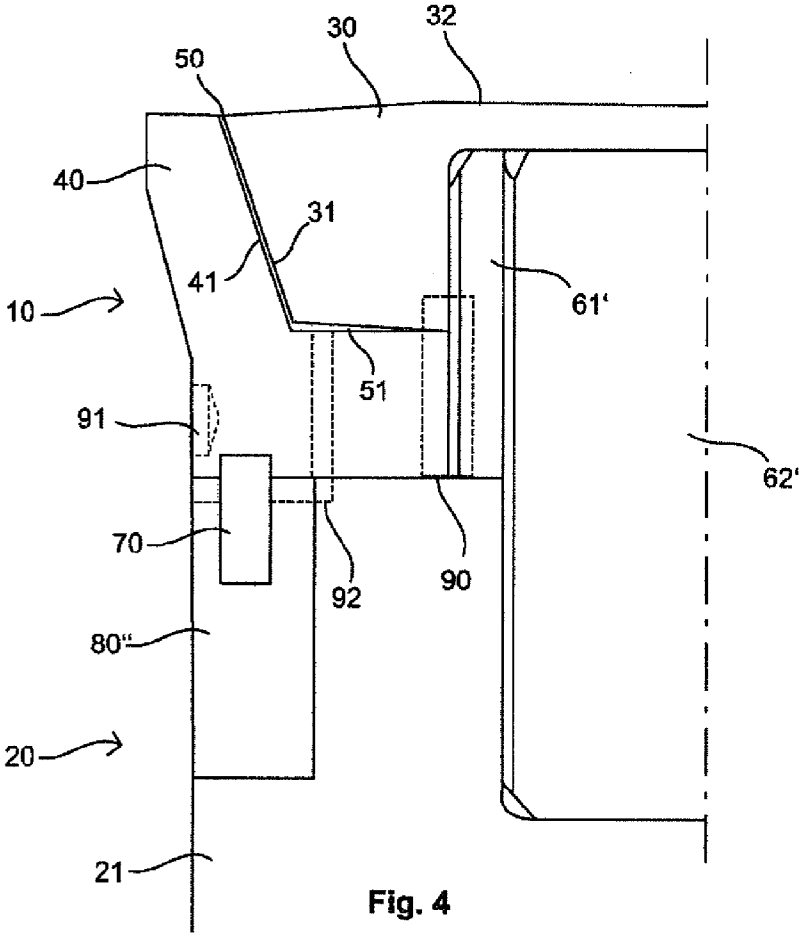
FIG. 4 a schematic view of a third embodiment of a dummy block according to the invention, in conjunction with the extrusion ram of an extrusion device, whereby the filler piece has a continuous pressing surface.

FIG. 4 shows another embodiment of the dummy block according to the invention, whereby this schematic half-section shows an embodiment in which the filler piece 30 has a continuous pressing surface 32. Although the adapter stud 62' of this embodiment extends into the filler piece 30, it does not penetrate it completely. The same applies to the connecting ring 61' that is also provided here as a connecting element. Here, the return force is transmitted from the connecting ring 61' to the sealing ring 40 by means of a threaded connection, but it is also possible to provide a step in the connecting ring as is shown in the embodiment of FIG. 3. Moreover, the filler piece 30 and the connecting ring 61' can also be configured in one piece, whereby, however, as set forth in this invention, the connecting ring 61' still has to be considered to be the connecting element by means of which the return force is transmitted to the sealing ring 40. By the same token, with this embodiment as well, at least part of the pressing force can be transmitted via the connecting ring 61'.

The return force can also be transmitted indirectly from the connecting ring 61' to the sealing ring 40 via the filler piece 30, which can be done by means of a threaded connection between the connecting ring 61' and the filler piece 30. The return force is likewise transmitted from the adapter stud 62' to the connecting ring 61' by means of a threaded connection.

Between the connecting ring 61' and the sealing ring, at least one pin connection 90 provides a positive connection, so that the connecting ring 61' can be detached from the adapter stud 62' by rotating the sealing ring 40. In order to be able to detach the entire dummy block as easily as possible, the connecting pin 90 can, at the same time, connect the filler piece to the connecting ring 61', which is indicated merely by a broken line for the sake of simplicity.

An outer ring 80" can once again be used to prevent the dummy block 10 from twisting relative to the extrusion ram 20, whereby in this embodiment, an outer ring having an axial bore and an axial connecting pin 70 is shown that can be affixed to the adapter 21 as desired.

In order to prevent the dummy block 10 from twisting relative to the extrusion ram 20, for example, in the embodiment of FIG. 4, a screw can also be provided that is screwed via the front into the connecting stud or into the adapter stud. The thread of this screw can have a direction of rotation that is opposite to the associated connecting element. Thus, the dummy block with the connecting ring 61' can be screwed onto the adapter stud 62' until the stop is reached. In the opposite direction, the screw is then screwed in from the front, so that the filler piece 30 is affixed to the adapter stud. The dummy block 10 is prevented from becoming detached from the adapter stud in that the dummy block cannot be unscrewed opposite to the direction of rotation of the screw. Such a screw is also suitable as an anti-twist means when a connecting ring is configured in such a way that its front surface covers an adapter stud, that is to say, although the adapter stud extends into the connecting ring in question, it does not penetrate it completely.

Figure 5:
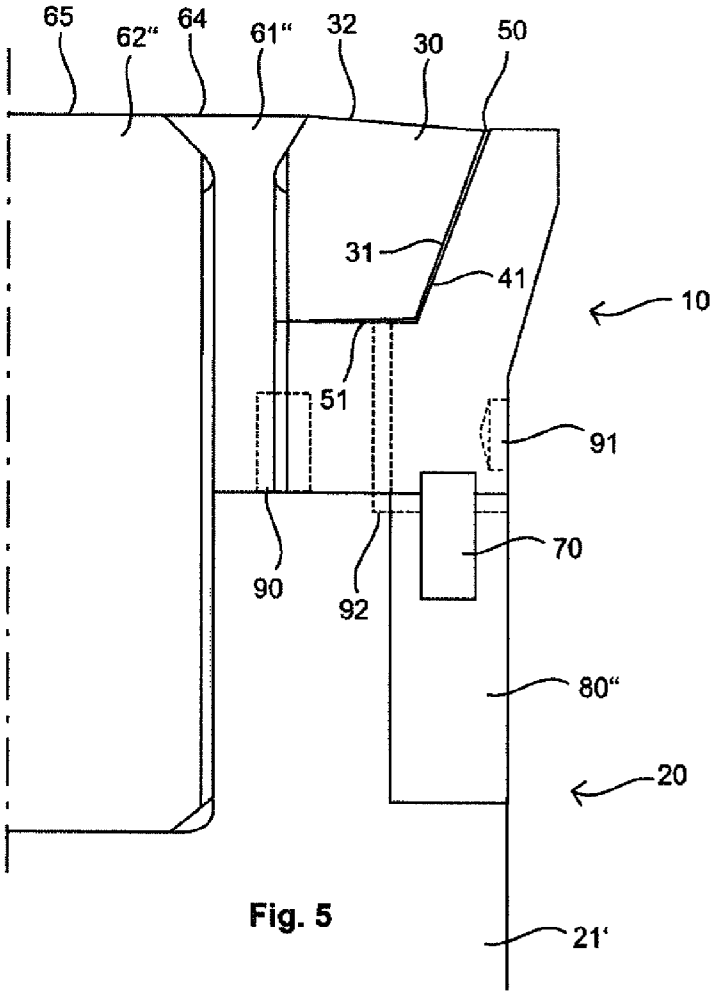
FIG. 5 a schematic view of a fourth embodiment of a dummy block according to the invention, in conjunction with the extrusion ram of an extrusion device, whereby the connecting element is a connecting ring, and an adapter piece forms part of the pressing surface.

FIG. 5 shows an embodiment of the dummy block according to the invention having a connecting ring 61" and an adapter stud 62" whose configuration and arrangement fundamentally match the embodiment of FIG. 3. However, the connecting ring 61" used here does not have a step with a tensioning surface to transmit the return force to the sealing ring 40. Rather, like in the embodiment of FIG. 4, the return force is transmitted by means of threaded connections that are each present between the connecting ring 61' and the sealing ring 40 as well as between the connecting ring 61" and the filler piece. This has no influence on the possibility to simultaneously transmit extrusion pressure to the adapter piece 21' via the connecting ring 61" and the sealing ring 40.

Here, too, the positive connection of the sealing ring 40 to the connecting ring 61" can be made by means of a pin connection 90, but this pin connection does not have to encompass the filler piece, since the latter is held at its front by the widening of the connecting ring 61".

Furthermore, here too, the connecting ring 61" can be configured in such a way that its front surface covers the adapter stud 62", that is to say, the front surface 64 of the connecting ring 61" forms the middle part of the entire pressing surface of the dummy block, whereas the filler piece 30 forms an outer surface. The adapter stud 62" then extends into the connecting ring 61", but it does not penetrate it completely.

In the case of a self-supporting connecting stud, as an alternative to a threaded connection by means of which parts in the extrusion ram 20 or in an adapter piece 21 of the extrusion ram 20 are secured against axial movement, it is also possible to select a bayonet connection with one or preferably several bayonet locks.

Figure 6:
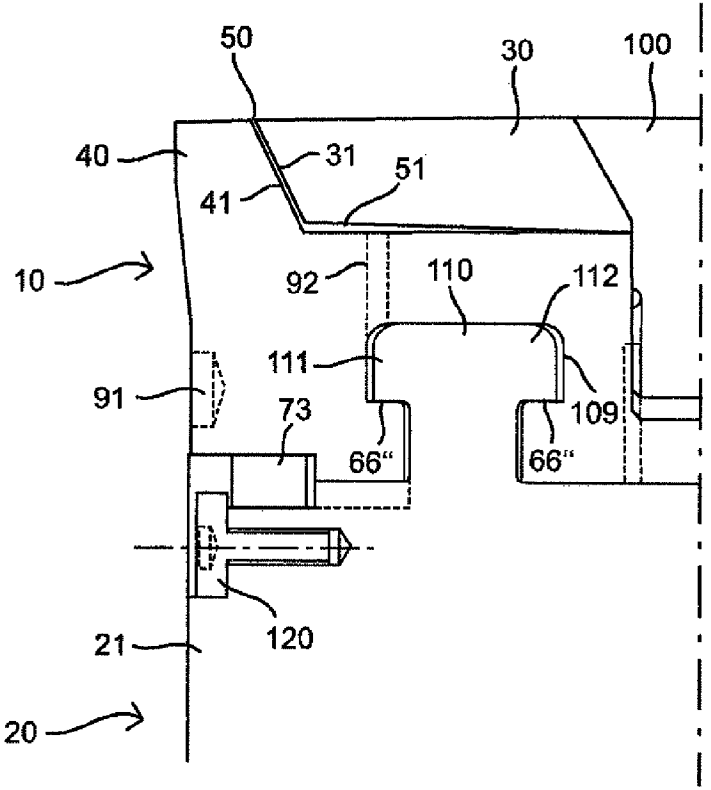
FIG. 6 a schematic view of a fifth embodiment of a dummy block according to the invention, in conjunction with the extrusion ram of an extrusion device, whereby the connecting element is a connecting member on the extrusion ram with a bayonet lock.

FIG. 6 shows a fifth embodiment of the invention in which the connecting element is a circumferential connecting member 110 that is attached to the extrusion ram 20 or to an adapter piece 21 of the extrusion ram 20. Preferably, this is a continuous ring-shaped connecting member that runs around the longitudinal axis of the dummy block 10, but the connecting member can also be configured so as to be discontinuous in sections. Here, the connecting member is installed on the surface of the adapter piece 21 that faces the sealing ring 40, and it extends into a corresponding circumferential recess 109 that is provided in the sealing ring 40. The connecting member 110 can be configured in one piece with the adapter piece 21 or else as a separate part that can be affixed to the adapter piece.

The circumferential connecting member 110 and the recess 109 have essentially the same shape, whereby there is a small amount of play between the connecting member 110 and the recess 109 so that the two parts can rotate relative to each other. In the embodiment shown in FIG. 6, several bayonet cams are provided on the outer edge as well as on the inner edge of the connecting member 110. FIG. 6 shows only one bayonet cam 111 on the outer edge and one opposite bayonet cam on the inner edge of the connecting member 110, whereby, however, additional bayonet cams are preferably arranged over the entire connecting member. For example, four bayonet cams can be provided at intervals of 90° on the outer edge and on the inner edge.

However, it is also possible to provide bayonet cams only on the outer edge or on the inner edge and, in contrast to the depiction in FIG. 6, the bayonet cams of the outer edge can also be arranged offset with respect to the bayonet cams of the inner edge.

The bayonet cams engage in guide slots (not shown here) that have been made in the side walls of the recess 109. These are, for instance, a slot in the lengthwise direction and a crosswise slot at the end of the lengthwise slot. Thus, the bayonet cams can be inserted into the lengthwise slots, and the end of the connecting member 110 can be turned in such a way that the bayonet cams latch in the crosswise slots, thereby preventing any further axial movement. A bayonet cam can be configured as an elevation having any desired shape on the circumference of the connecting member 110, whereby the bayonet cam extends about 2.5 mm to 15 mm from the connecting member 110. Preferably, the bayonet cams are formed by a circumferential crown having several interruptions, whereby the areas between the interruptions form the bayonet cams that can engage into the correspondingly wide guide slots in the recess 109.

In this embodiment, the filler piece 30 is connected to the sealing ring 40 by the connecting member, irrespective of the connecting element that is selected. For example, this can be done by means of a fastening stud 100 that is screwed into the filler piece 30 and the sealing ring 40, and that is additionally secured against twisting by a pin connection 73, indicated only by a broken line. Here, the front of the fastening stud 100, together with the filler piece 30, forms part of the pressing surface. In this manner, through a push-turn movement, the sealing ring 40, together with the filler piece 30 and the fastening stud 100, can be turned onto the connecting member 110, and secured against axial movement by the bayonet lock.

The sealing ring 40 and thus of the dummy block 10 can also be rotated using indentations 91 that are situated on the side of the sealing ring 40. At least one lateral pin connection 73 can be provided to prevent the dummy block 20 from twisting relative to the adapter piece 21, whereby the pin employed in the embodiment of the invention shown in FIG. 6 can be secured against falling out by means of another screw 120.

In this embodiment, the return force of the extrusion ram 20 can be transmitted from the adapter piece 21 to the sealing ring 40 via the tensioning surfaces 66" in the area of the bayonet cams, whereas the compressive forces can be completely absorbed by the front surface of the connecting member 110. Moreover, the air can be discharged laterally from the gap 51 through venting channels 92 over a short distance via the recess 109.

Through the selection of suitable dimensions and tolerances, the compressive forces that are transmitted to the dummy block by the material to be pressed can be transmitted to the corresponding surface in the recess 109, 109' via the end face of the connecting member 110, 110' between the bayonet cams 111, 112, 111', 112', as well as to the surface of the adapter piece 21 via the surface of the sealing ring facing away from the material to be pressed. In this context, the term connecting member 110, 110' refers to a ring-shaped connecting element if several bayonet cams 111, 112, 111', 112' are installed, for example, facing inward towards the center axis of the dummy block 10 and facing outward away from the center axis of the dummy block 10, whereas the term connecting member 110, 110' refers to a circular connecting element if the bayonet cams 111, 111', or 112, 112' are installed facing only inward towards the center axis of the dummy block 10 or facing only outward away from the center axis of the dummy block 10. In addition, however, any other suitable shape of the connecting element is possible. A suitable double fit can be made as a function of the elasticity of the sealing ring 40 by observing a tolerance of a few hundredths of a millimeter, which can be achieved without any problem using the appropriate machine tools. For example, observing a tolerance of ±0.03 mm has proven to be sufficient when a suitable hot work steel is used for the sealing ring 40. Depending on the material pairing, on the occurring compressive forces and on the diameter of the dummy block, it is sufficient if the surfaces are only partially in contact when under compressive load.

Figure 7:
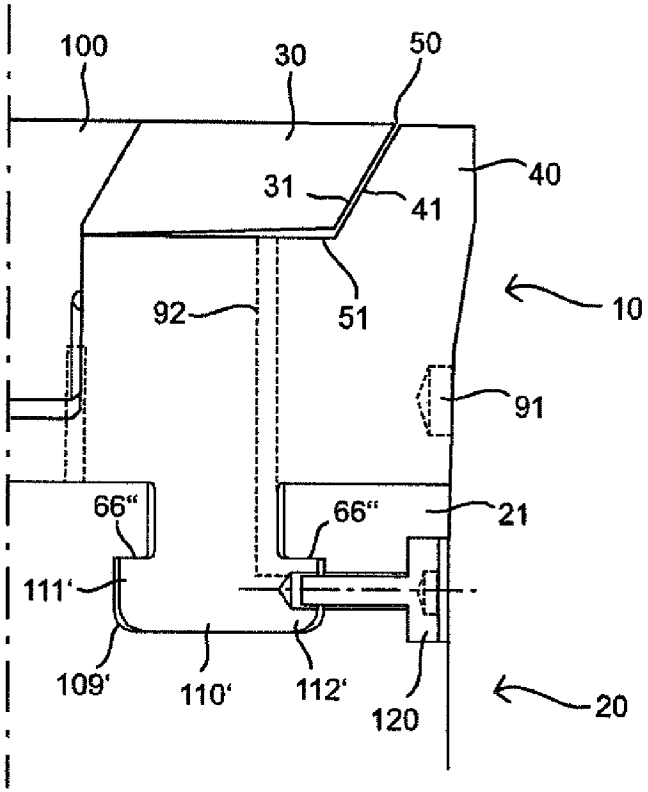
FIG. 7 a schematic view of a modification of the embodiment as shown in FIG. 6.

As an alternative, this embodiment can also be modified as shown in FIG. 7, and a circumferential connecting member 110' can be shaped onto the sealing ring 40, while there is a corresponding recess 109' in the adapter piece 21 that serves to accommodate the connecting member 110' during the installation. Appropriate bayonet cams 111' and 112' are formed on the connecting member 110', and here, too, the dummy block 10 can be installed on or dismantled from the adapter piece 21 by means of a push-turn movement. Preventing the sealing ring 40 from twisting relative to the adapter piece 21 could be achieved by means of at least one screw 120 that would be screwed into the adapter piece 21 and then into the connection member 110'. The height dimensions of the areas of the connecting member 110, 110', the sealing ring 40 and the adapter piece 21, 21', 21" can be coordinated analogously to the previous embodiment.

FIGS. 6 and 7 each show a double bayonet with bayonet cams 111, 112, 111', 112' on the inside as well as on the outside of the connecting member 110, 110'. This is not a limitation pertaining to other types of bayonets either. For example, it would also be conceivable to have a bayonet with bayonet cams 111, 111' or 112, 112' arranged only on one side, which entails advantages from a manufacturing standpoint.

This embodiment can be advantageous, for example, for smaller diameters of the dummy block if there were not enough space in the sealing ring 40 for a suitable connecting member without weakening the sealing ring 40 excessively. Due to the connecting member 110', the total height of the dummy block is greater than in the embodiment of FIG. 6, but if the overall height is considered to be only the distance between the pressing surface and the adapter piece, then the overall height does not have to change. In this modification of the fifth embodiment, the return forces can advantageously be transmitted from the adapter piece 21 to the connecting member 110' and thus to the sealing ring 40 via the tensioning surfaces 66" in the area of the bayonet cams.

Figure 8:
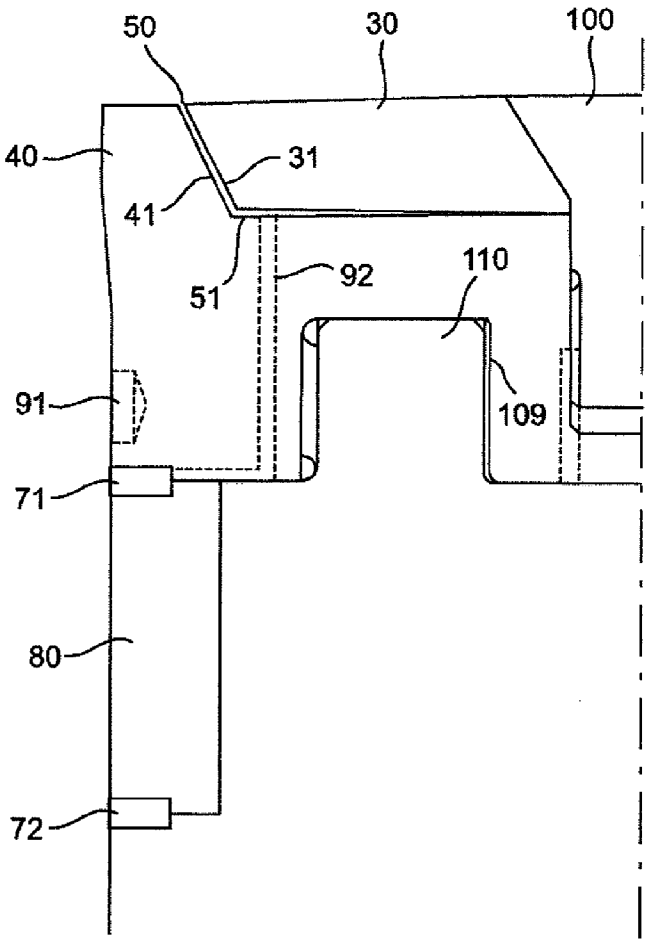
FIG. 8 a schematic view of a sixth embodiment of a dummy block according to the invention, in conjunction with the extrusion ram of an extrusion device, whereby the connecting element is a connecting member on the extrusion ram with a threaded connection.

FIG. 8 shows a sixth embodiment of the invention in which a connecting member 110 on the adapter piece 21 and a recess 109 in the sealing ring 40 were selected as the connecting element. As the means for establishing and releasing a secured connection against axial movement between the connecting member 110 and the recess 109, however, a thread is provided so that the connecting member 110 is screwed into the recess 109. The return forces are transmitted by means of the thread, but the entire front surface of the connecting member 110 is available for absorbing the compressive forces. An outer ring 80 and pin connections 71 and 72 can be used as the anti-twist means, as was explained in conjunction with FIG. 3. Once again, air can be discharged laterally from the gap 51 through venting channels 92.

Figure 9:
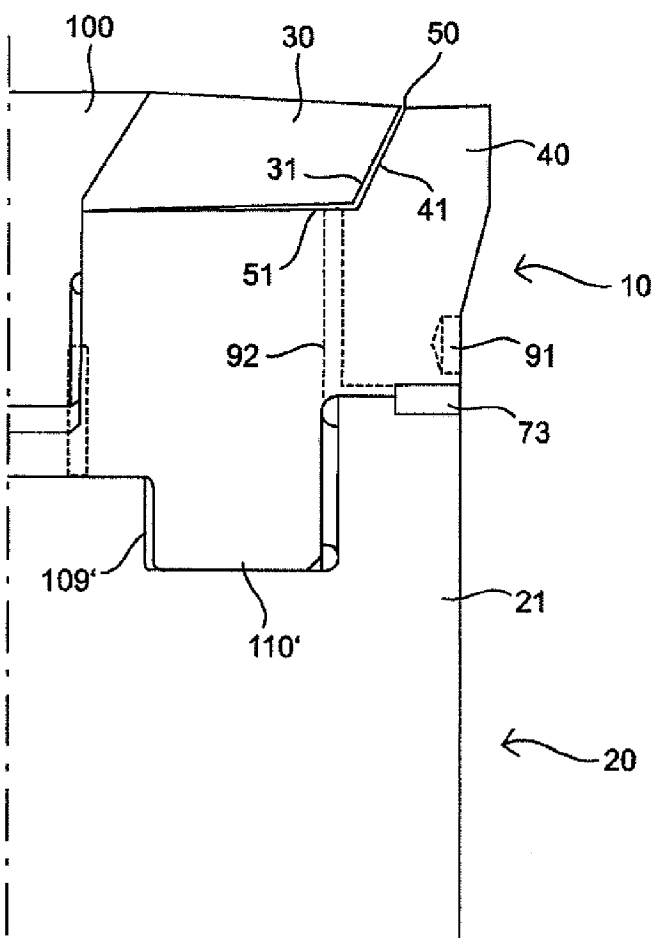
FIG. 9 a schematic view of a modification of the embodiment as shown in FIG. 8.

FIG. 9 shows a modification of the embodiment of FIG. 8, whereby the structure was reversed as compared to the embodiment of FIG. 7, so that the connecting member 100' is now installed on the sealing ring 40 and the recess in the adapter piece 21. Moreover, the shape of the sealing ring 40 was changed and configured to be step-like towards the adapter piece 21, so that the connecting member 110' and thus the recess 109' have different heights at their appertaining outer and inner edges.

In all of the embodiments, a sealing ring 40 can also be configured, for example, in two pieces, whereby the two partial pieces of the sealing ring are then connected to each other, for instance, by means of a pin connection. The sealing ring 40 can also be made up of more than two parts, which are connected to each other in such a way that a rotation of the outer part brings about a rotation of all of the parts connected thereto. This has the advantage that parts that have worn out can be replaced individually, which is especially the case for an outer part that encompasses the inner conical surface 41 and that, together with this surface, forms the gap 50 vis-à-vis the outer conical surface 31 of the filler piece.

In all of the embodiments of the invention shown, the sealing ring 40 has a greater overall height on the outside than on the inside, so that between these areas having different overall heights, a step is formed that opens up into the contact surface of the filler piece 30.

At the transition zone between these two areas, an axial notch can be provided in the sealing ring in every embodiment. Due to this notch, the sealing ring 40 spreads more easily at a defined point in time.

Moreover, an intermediate element can be provided between the radial surfaces of the sealing ring 40 and the filler piece 30. This intermediate element entails the advantage, for example, that the above-mentioned notch in the sealing ring 40 does not have to be made so deep, since this might not be possible for reasons having to do with manufacturing technology. Thus, a notch with a small depth can be provided, but the intermediate element functionally enlarges the sealing ring in the direction of the filler piece 30 and then, together with the filler piece 30, forms the radial gap 51.

However, such an intermediate element can also be configured in such a way that, under continuous pressure during the operation of the dummy block, its thickness is reduced or more greatly reduced than the thickness of the filler piece 30 and of the sealing ring 40. In this manner, it can be achieved that the gap 51 between the filler piece 30 and the sealing ring 40 is not detrimentally reduced due to wear and tear of these parts, since the simultaneous reduction in thickness of the intermediate element would nevertheless ensure an adequate gap between the two parts.

The targeted reduction of the thickness of the intermediate element can be achieved, for instance, by an intermediate element made of a material that is not very hard. As an alternative or in addition to this, at least one pressure-loaded surface of the intermediate element could be provided with several grooves or slots whose height is reduced due to wear and tear as well as pressure during the operation of the press, as a result of which the overall height of the intermediate element would be reduced.

If the filler piece 30 is supported by a floating bearing between the sealing ring 40 and a connecting element, measures might become necessary to prevent the gap 50 between the filler piece 30 and the sealing ring 40 from becoming detrimentally small. For this purpose, adjoining its outer conical surface 32, the filler piece 30 can have a contact surface that runs essentially axially in the direction of the extrusion ram 20 and that is located opposite from an equidirectional contact surface of the sealing ring 40, whereby the contact surface of the sealing ring 40 adjoins its inner conical surface 41. If the radial distance between these two contact surfaces is selected to be less than the radial distance between the inner conical surface 41 of the sealing ring 40 and the outer conical surface 32 of the filler piece 30, the result is that the two contact surfaces are brought into contact with each other before the gap 50 between the filler piece and the sealing ring 40 is reduced to zero. Otherwise, it would be possible for the gap 50 to be reduced to zero, while a large gap would remain between the filler piece 30 and the connecting element, whereby this gap might be neither necessary nor even desirable.

LIST OF REFERENCE NUMERALS

10 dummy block
20 extrusion ram
21, 21',21" adapter piece
23 connecting surface of the adapter piece
30 filler piece
31 outer conical surface
32 pressing surface of the filler piece
40 sealing ring
41 inner conical surface
50, 51 gap
60 connecting stud
61, 61', 61" connecting ring
62, 62', 62" adapter stud
63 pressing surface of a connecting stud
64 pressing surface of a connecting ring
65 pressing surface of an adapter stud
66, 66', 66" tensioning surface
70, 71 pin connection between the sealing ring and the outer ring
72 pin connection between the outer ring and the adapter piece
73 pin connection between the sealing piece and the adapter piece
80, 80', 80" outer ring
81, 82 end face
90 pin connection between the sealing ring and the connecting element
91 indentation
92 venting channel
100 fastening stud
110, 110' connecting member
111, 111' bayonet cam on the outside
112, 112' bayonet cam on the inside
120 screw

STATE OF THE ART

1 sealing ring
2 intermediate ring
3 filler piece
3A gap
4 centering stud
5 dummy block core
6 nut
7 securing pin
8 centering pin
9 supporting ring
11 extrusion ram
12 connecting stud, tie rod
13,14 bore
16 pressing surface

The invention claimed is:

1. A system including a dummy block and an extrusion ram, wherein the dummy block is installable on the extrusion ram of an extrusion device, the dummy block comprising at least one filler piece having a pressing surface via which a force can be exerted onto a material that is to be extruded, and an outer diameter of the filler piece being configured conically with an outer conical surface and being surrounded by a sealing ring which forms part of the dummy block and whose inner diameter is dimensioned such that an inner conical surface of the sealing ring and the outer conical surface of the filler piece form a gap, and, between the filler piece and the sealing ring, there is at least one radial gap that widens conically from an inside portion towards an outside portion, whereby the filler piece and the sealing ring can be installed on the extrusion ram by means of a connecting element, and a return force of the extrusion ram can be transmitted to the sealing ring via the connecting element, said sealing ring being rotatable around the axis of rotation of the dummy block and, depending on the direction of rotation, a secured connection of the dummy block to the extrusion ram against axial movement can be established or released such that the sealing ring and the filler piece can be installed in and dismantled from the extrusion ram via a side of the dummy block, said dummy block further comprising the connecting element, and said connecting element being a circumferential connecting member having an end face that can absorb the compressive forces during an extrusion process, whereby at least part of the end face of the connecting element and at least part of an adapter surface of an adapter piece are relatively movable and said at least part of the end face of the connecting element is in contact with said at least part of said adapter surface of the adapter piece, and at least part of an inner surface of the sealing ring opposite from and spaced from the material to be pressed is likewise in contact with at least part of the surface of the adapter piece when extrusion pressure is applied onto the dummy block and whereby prior to the application of extrusion pressure onto the dummy block, said at least part of the end face of the connecting element is not in contact with said at least part of said adapter surface of said adapter piece to permit venting of air during the application of extrusion pressure onto the dummy block.

2. The system according to claim 1, wherein the sealing ring is connected to the connecting element in such a way that a rotation of the sealing ring about the axis of rotation of the dummy block brings about an equidirectional rotation of the connecting element about the axis of rotation of the dummy block as a result of which, depending on the direction of rotation, it is possible to establish or release a secured connection of the connecting element to the extrusion ram against axial movement, and, together with the sealing ring and the filler piece the connecting element can also be installed in or dismantled from the extrusion ram via the side of the dummy block.

3. The system according to claim 2, wherein the connecting element has at least one step with an essentially radial tensioning surface on its circumference, and, via this tensioning surface the return force of the extrusion ram can be transmitted to the sealing ring via the connecting element.

4. The system according to claim 2, wherein the connecting element is a connecting stud that can be secured to the extrusion ram against axial movement, and that extends through the sealing ring into the filler piece whereby the connecting stud is configured in such a way that it secures the filler piece as well as the sealing ring against axial movement.

5. The system according to claim 2, wherein the connecting element is a connecting ring that surrounds an adapter stud whereby the adapter stud is secured to the extrusion ram against axial movement, and the connecting ring is secured to the adapter stud against axial movement, while the sealing ring is secured to the connecting ring against a rotatory movement, and in that a rotation of the sealing ring around the axis of rotation of the dummy block brings about an equidirectional rotation of the connecting ring around the axis of rotation of the dummy block as a result of which, depending on the direction of rotation, the connecting ring is connected to or disconnected from the adapter stud.

6. The system according to claim 1, wherein by rotating the sealing ring about the axis of rotation of the dummy block depending on the direction of rotation, it is possible to establish or release a secured connection of the sealing ring to the connecting element against axial movement, as a result of which the sealing ring and the filler piece can be installed in and dismantled from the extrusion ram via the side of the dummy block while the connecting element remains on the extrusion ram.

7. The system according to claim 1, wherein the filler piece is secured to the sealing ring against axial movement, and the connecting element is a circumferential connecting member that extends into a corresponding circumferential recess whereby means are provided between the connecting member and the recess for establishing and releasing a secured connection between the sealing ring and the extrusion ram against axial movement, and via these means, the return force of the extrusion ram can be transmitted to the connecting member and thus to the sealing ring.

8. The system according to claim 7, wherein the connecting member is installed on the sealing ring and it extends into a corresponding circumferential recess in the extrusion ram.

9. The system according to claim 7, wherein the connecting member is installed on the extrusion ram and it extends into a corresponding circumferential recess in the sealing ring.

10. The system according to claim 7, wherein the means for establishing and releasing a secured connection between the sealing ring and the extrusion ram against axial movement comprise a bayonet lock.

11. The system according to claim 10, further comprising at least two bayonet cams on the outer and/or inner edge of the connecting member while corresponding guide slots are provided on the outer and/or inner edge of the recess in order to receive these bayonet cams.

12. The system according to claim 1, wherein the dummy block comprises an intermediate element that is arranged between radial surfaces of the sealing ring and of the filler piece.

13. The system according to claim 12, further comprising at least one groove that is created in at least one pressure-loaded surface of the intermediate element, and/or the intermediate element is made of a material that is not as hard as the material of the filler piece and/or of the sealing ring.

14. The system according to claim 1, wherein the filler piece is supported by a floating bearing between the sealing ring and the connecting element and, adjoining its outer conical surface, the filler piece having a contact surface that runs substantially axially in the direction of the extrusion ram and that is located opposite from an equidirectional contact surface of the sealing ring whereby the contact surface of the sealing ring adjoins its inner conical surface, and in that the radial distance between these two contact surfaces is less than the radial distance between the inner conical surface of the sealing ring and the outer conical surface of the filler piece.

15. The system according to claim 1 wherein said at least part of the inner surface of the sealing ring opposite from and spaced from the material to be pressed is not in contact with said at least part of the surface of the adapter piece to permit venting of air during the application of extrusion pressure onto the dummy block.

16. A system including a dummy block and an extrusion ram, wherein the dummy block is installable on the extrusion ram of an extrusion device, the dummy block comprising at least one filler piece having a pressing surface via which a force can be exerted onto a material that is to be extruded, and an outer diameter of the filler piece being configured conically with an outer conical surface and being surrounded by a sealing ring which forms part of the dummy block and whose inner diameter is dimensioned such that an inner conical surface of the sealing ring and the outer conical surface of the filler piece form a gap, and, between the filler piece and the sealing ring, there is at least one radial gap that widens conically from an inside portion towards an outside portion, whereby the filler piece and the sealing ring can be installed on the extrusion ram by means of a connecting element, and a return force of the extrusion ram can be transmitted to the sealing ring via the connecting element, said sealing ring being rotatable around the axis of rotation of the dummy block and, depending on the direction of rotation, a secured connection of the dummy block to the extrusion ram against axial movement can be established or released such that the sealing ring and the filler piece can be installed in and dismantled from the extrusion ram via a side of the dummy block, said dummy block further comprising the connecting element, and said connecting element being a circumferential connecting member having an end face that can absorb the compressive forces during an extrusion process, whereby at least part of the end face of the connecting element is in contact with at least part of an adapter surface of an adapter piece, and at least part of an inner surface of the sealing ring opposite from and spaced from the material to be pressed and at least part of the surface of the adapter piece are relatively movable and said at least part of the inner surface of the sealing ring opposite from and spaced from the material to be pressed is likewise in contact with said at least part of the surface of the adapter piece when extrusion pressure is applied onto the dummy block and whereby prior to the application of extrusion pressure onto the dummy block, said at least part of the inner surface of the sealing ring opposite from and spaced from the material to be pressed is not in contact with said at least part of the surface of the adapter piece to permit venting of air during the application of extrusion pressure onto the dummy block.

* * * * *